United States Patent [19]

Farrell et al.

[11] Patent Number: 5,069,513

[45] Date of Patent: Dec. 3, 1991

[54] MOBILE SHELVING SAFETY FLOOR

[75] Inventors: Richard B. Farrell, New York; James H. Rogers, Middle Village, both of N.Y.

[73] Assignee: Automated Storage & Retrieval Systems of America, New York, N.Y.

[21] Appl. No.: 589,322

[22] Filed: Sep. 27, 1990

[51] Int. Cl.[5] ..... A47B 53/00

[52] U.S. Cl. ..... 312/201; 104/295; 200/86.5

[58] Field of Search ..... 312/198, 199, 200, 201; 200/86.5, 86 R, 86 A; 104/288, 295

[56] References Cited

U.S. PATENT DOCUMENTS

| | | | |
|---|---|---|---|
| 3,596,024 | 7/1970 | Smith . | |
| 3,829,189 | 8/1974 | Staller . | |
| 3,890,903 | 6/1975 | Showell | 104/295 |
| 3,957,323 | 5/1976 | Tucker . | |
| 4,017,131 | 4/1977 | Camenisch | 104/295 |
| 4,033,649 | 7/1977 | Naito et al. . | |
| 4,455,466 | 4/1982 | Wilson . | |
| 4,616,888 | 9/1984 | Peterman . | |
| 4,693,184 | 9/1987 | Peterman | 104/295 |
| 4,744,307 | 5/1988 | Peterman et al. . | |

*Primary Examiner*—James R. Brittain
*Assistant Examiner*—Gerald A. Anderson
*Attorney, Agent, or Firm*—Rosen, Dainow & Jacobs

[57] ABSTRACT

A safety floor construction comprising plural floor sections suspended on springs such that each floor section is depressed whenever a person stands on that floor section while in an aisle between carriages. One or more safety switches are mounted on each carriage. The switch actuators engage the floor sections. When a floor section is depressed by a user, the switch is actuated and interrupts the motor drive circuit for the carriages. Thus, the adjacent carriages cannot move.

The movable floor is constituted of individual reinforced plywood panels provided at their edges with metal which are contacted by the spring supports. Moreover, the floor panel spring supports are mounted under the rail attached to the sub floor and require no attachment to the panel.

13 Claims, 7 Drawing Sheets

FIG. 5A
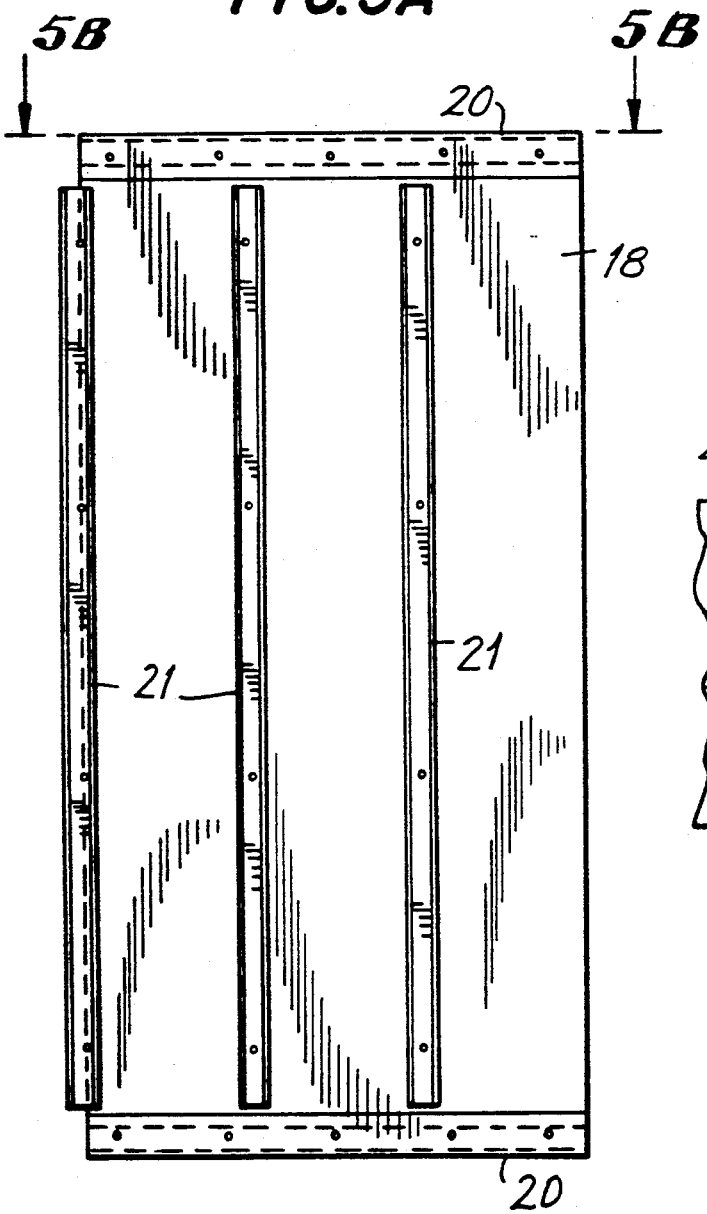
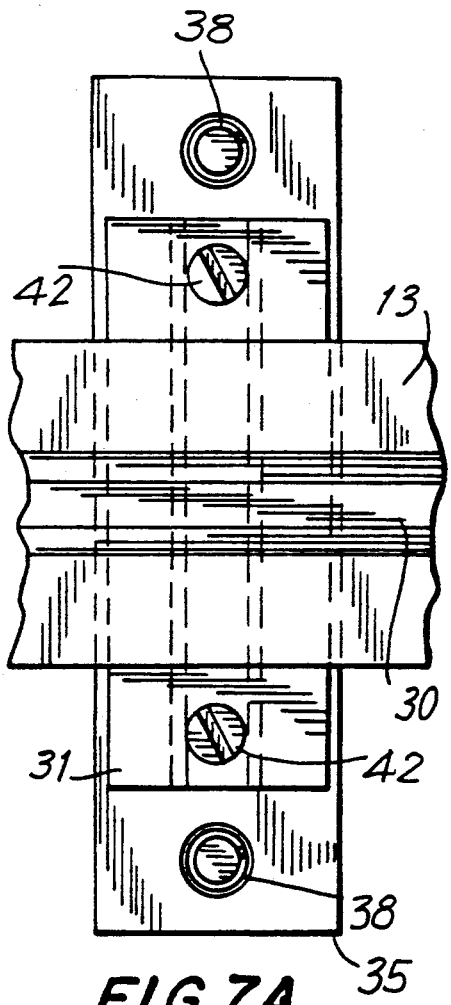
FIG. 7A
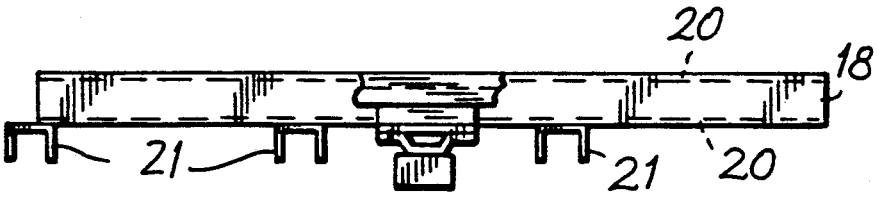
FIG. 5B

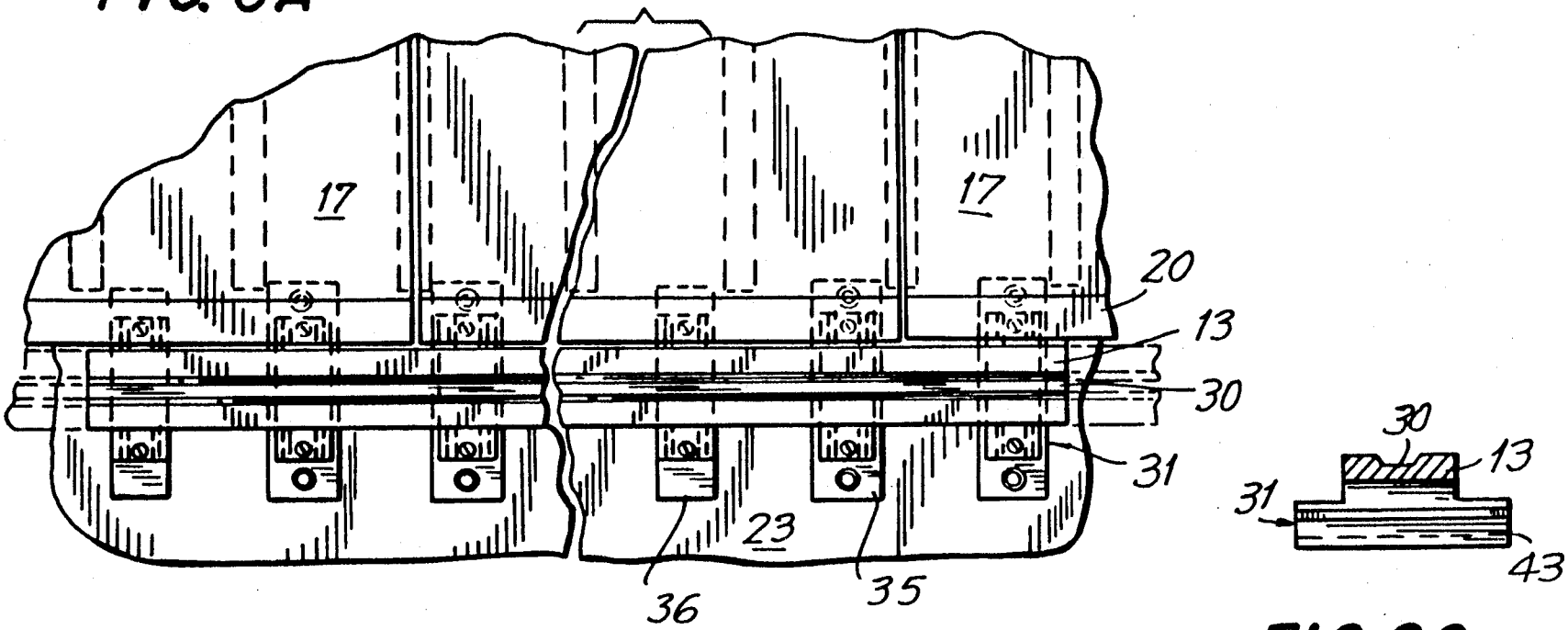
FIG. 6A
FIG. 6C
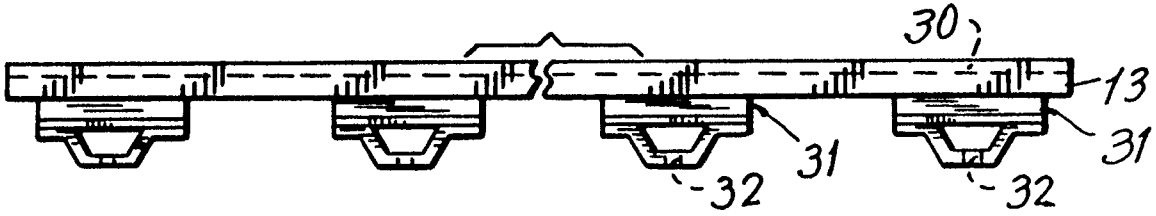
FIG. 6B

MOBILE SHELVING SAFETY FLOOR

RELATED APPLICATION

Commonly-assigned, copending U.S. patent application, Ser. No. 505,248, filed Apr. 3, 1990, entitled "Automatic Locking Device For Movable Shelving" (ASR-101).

BACKGROUND OF INVENTION

This invention relates to movable shelving or storage carriages or racks, and in particular to aisle safety floors to prevent carriage movement when a person is present in an open aisle.

The related copending patent application, whose contents are herein incorporated by reference, describes a conventional mobile shelving system comprising movable wheeled carriages supporting storage shelving or racks. The carriages ride on rails to provide open aisles to access the stored items on the carriages. Many such installations employ motor drives operable by users via control systems located at the entrance to each aisle. Multiple aisles may be created without disrupting any aisles currently in use. Safety systems are usually present to prevent injury to a person standing in an open aisle. One such safety system locks adjacent carriages when an aisle is opened. However, the locks can be manually overridden by a second user who is unaware that a first user may still be present in the aisle. Another safety system employs safety bars that are mounted at several levels on the carriage sides. When a contact is made by a person or object in the aisle, the safety bar is depressed which actuates a switch which interrupts the motor drive circuit, immediately stopping the carriages. However, even though this system ensures that no more than slight contact will be made with a person before the moving carriages stop, it can temporarily frighten a user who does not expect moving carriages closing down the aisle he or she occupies.

U.S. Pat. Nos. 4,744,307 and 3,957,323 describe a safety floor system in which the floor under the mobile storage system is spring mounted. A person standing on the floor depresses a floor section that actuates a switch mounted on the floor and which interrupts the motor drive preventing carriage movement. This construction tends to be complex, expensive and requires more floor space, which may limit the height of the carriages. Further, malfunctions may arise due to accumulation of dirt or moisture under the floor where the switch is located.

SUMMARY OF INVENTION

A principal object of the invention is a mobile storage system provided with a relatively inexpensive safety floor that features low-cost installation and low-cost maintenance.

Another object of the invention is a mobile storage system with a safety floor in which no electrical components need be placed under the floor.

A further object is a safety floor requiring only a small increase in floor level.

These and other objects and advantages of the invention are achieved with a safety floor construction comprising plural floor sections mounted such that each floor section moves whenever a person stands on that floor section while between carriages. In accordance with one aspect of the invention, one or more safety switches are mounted on each carriage. The switch actuators engage the floor sections. When a floor section moves, the switch is actuated and interrupts or locks the drive system. Thus, the adjacent carriages cannot move.

In the preferred embodiment the floor moves vertically, e.g. is depressed, when a person stands on it.

In the system of the invention, the only components beneath the floor are rugged mechanical elements capable of withstanding the effects of accumulated dirt or moisture. The safety electrical components can be simple microswitches with roller actuators which ride on and over the floor surface. The under-floor mechanical elements can be kept shallow in height; hence, only a modest increase in floor height is necessary compared with a system without a safety floor.

A further advantage is that the floor safety switch can easily be connected into the same safety circuit as the switches used in the safety bars, so that this valuable safety feature can be readily incorporated in new installations at only a modest additional cost.

According to further features of the invention, the movable floor is constituted of individual reinforced plywood panels, suspended on springs, provided at their edges with a metal strip which is contacted by the spring supports. Moreover, the floor panel spring supports are mounted on the sub-floor or existing floor and require no attachment to the panel. These features reduce overall cost and extend the lifetime of the installation. Further, the floor panels are easily removed for replacement of the springs should that become necessary.

An exemplary embodiment in accordance with a preferred embodiment of the invention will now be described in connection with the accompanying drawings, but this is not intended to be limiting in any way.

SUMMARY OF DRAWINGS

In the drawings:

FIGS. 5–8 are detail views of various components of the system of FIG. 2;

DETAILED DESCRIPTION OF PREFERRED EMBODIMENTS

Figure 1:
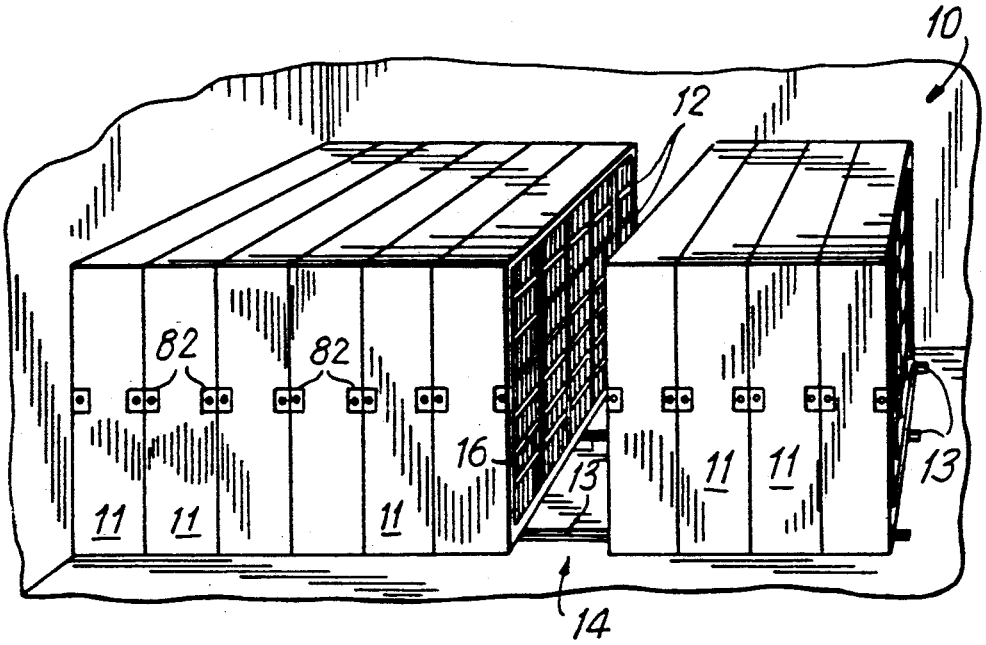
FIG. 1 is a perspective view of a typical mobile shelving system.
Figure 3:
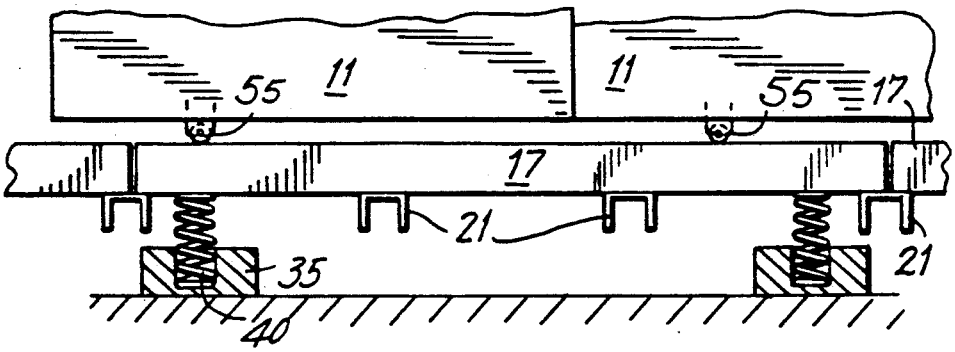
FIG. 3 and 4 are cross-sectional views of the system of FIG. 2 along the lines the 3—3 and 4—4, respectively.

FIG. 1 shows a typical mobile shelving installation generally of the type described in the aforementioned related application. The system 10 comprises a plurality of movable carriages 11 that contain storage means for various items, such as shelves 12 for files or racks for holding objects. To reduce the amount of floor space required, most of the aisle space required to access fixed shelving is eliminated by making substantially all of the stacks 11 mobile. This is accomplished by providing wheels on the stacks to form carriages, and mounting rails 13 on the floor along which the carriages 11 can be moved. In the related application, a mechanism driving mechanical is provided to move each carriage. In the preferred embodiment of the present invention, electrical motors are used to move the carriages to open up an access aisle 14 between adjacent carriages wherever the user desires. Also shown in FIG. 1 are conventional safety bars 16. These are elongated strips extending along the sides of each carriage, usually at two different levels, and are connected to electrical switches arranged in the driving circuit for the motors. If the carriages should accidentally close on a person or object present in an open aisle, the switch is triggered and the motors disabled. Commonly-assigned U.S. Pat. No. 4,033,649, whose contents are hereby incorporated by reference, shows conventional circuits that can be employed for such systems. The details thereof are unnecessary to the present invention which simply adds additional safety switches either in series or in parallel with other safety switches which similarly function to disable the motor drive when triggered. An example of one such circuit will be described hereinafter.

Figure 2:
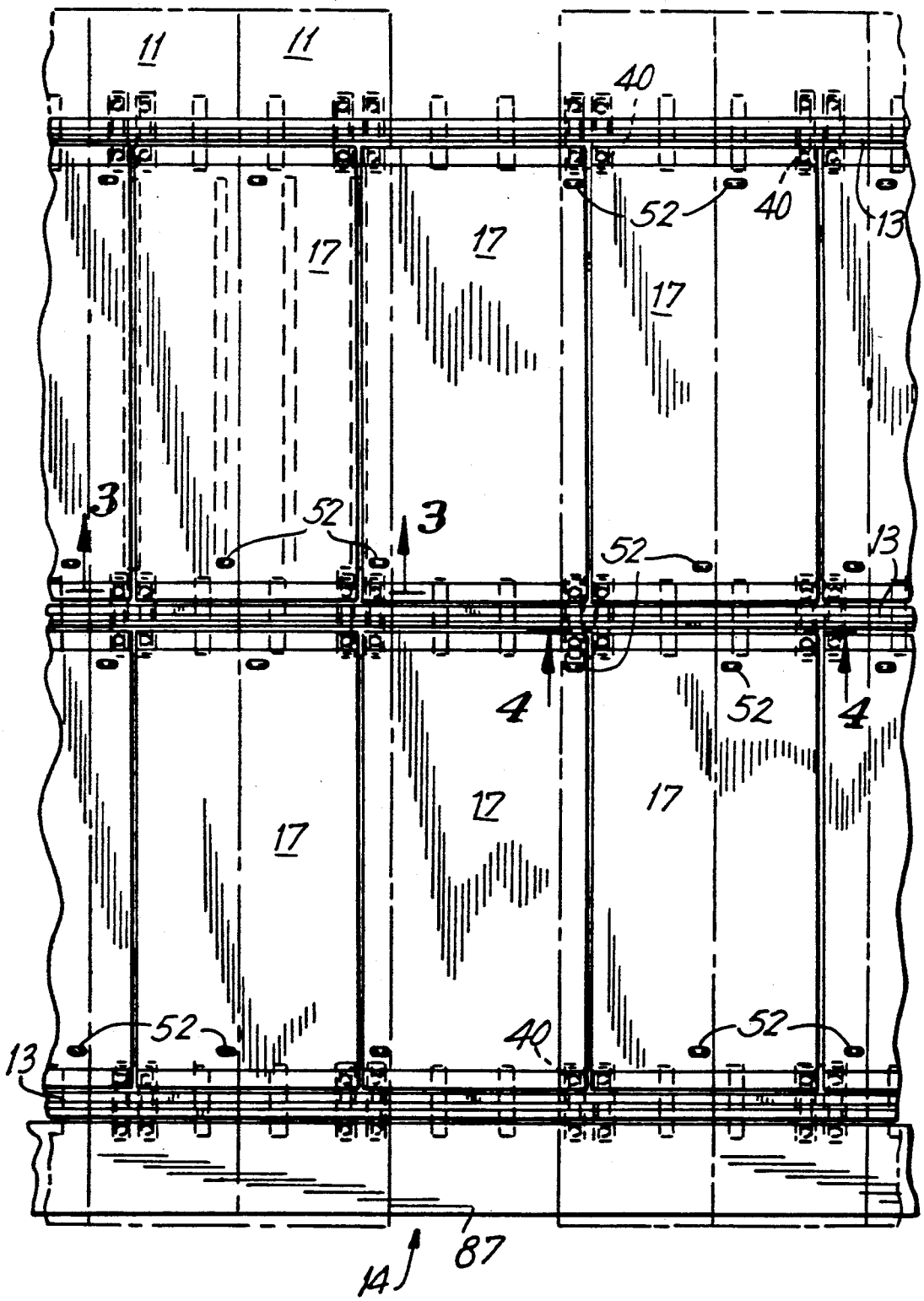
FIG. 2 is a top view of one form of system according to the invention depicting the safety floor layout.

FIG. 2 shows a typical floor layout in accordance with the invention. Between the rails 13 are located a plurality of floor sections 17 laid side by side to provide a suitable support for users who wish to access stored items via an open aisle 14. Each floor panel 17 is shown in more detail in the plan and elevational views, respectively, of FIGS. 5A and 5B and comprise a plywood panel 18 provided at its ends with a U-shaped cap 20 and reinforced from below with U-shaped metal channels 21 to prevent sagging. To reduce costs, inexpensive plywood can be used for the floor sections, or some other natural or synthetic material. Typically, such materials are relatively soft. The metal caps 20 at the ends, preferably of stainless steel, provide a relatively harder material to protect the softer wood against damage by contacting components, and also a perfectly smooth surface for the switch roller.

The installed floor panels 17 are resiliently suspended in a floating manner above a solid sub-floor 23. This is achieved in accordance with the invention as follows.

Instead of mounting the rail 13 via pads—typically used to anchor the rail—directly on the subfloor 23, the rails are elevated by a combination of blocks and shims on which the pads are mounted. FIGS. 6A and 6B are detailed plan and elevational views of a typical rail 13. The rail 13 comprises an elongated steel member having a grooved track 30 along which the carriage wheels ride, and welded to its bottom a plurality of spaced steel transversely-extending pads 31 provided with openings 32 for bolts to anchor the rail to the sub-floor. The rails are supported via their pads 31 on blocks 35 and shims 36. The blocks 35 comprise openings 37 for passage of bolts and end blind holes 38 for receiving and supporting heavy duty, coil, compression springs 40. Preferably, the springs 40 are of the heavy duty type known as tool and die springs. As depicted in the detailed plan and elevational views of FIGS. 7A and 7B, a pad 31 sits on top of a block 35, a bolt 42 passes through the aligned holes 32 and 37, respectively, in the pad and block and is anchored to the sub-floor 23. The floor sections 18 rest on top of the springs 40 over the ends 43 of the pads 31 (not shown in FIG. 7A) between or adjacent a rail section. The thickness of the floor sections 18 is chosen so that in their rest position, undeflected, they are substantially level with the rails 13. As will be observed, the harder steel caps 20 on the floor section ends actually contact and rest on the springs 40. This avoids possible damage to the plywood.

Figure 4:
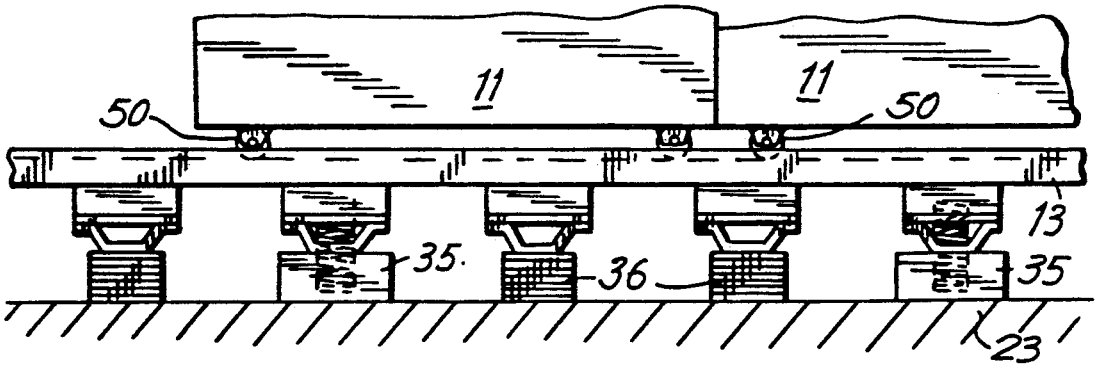
Figure 7B:
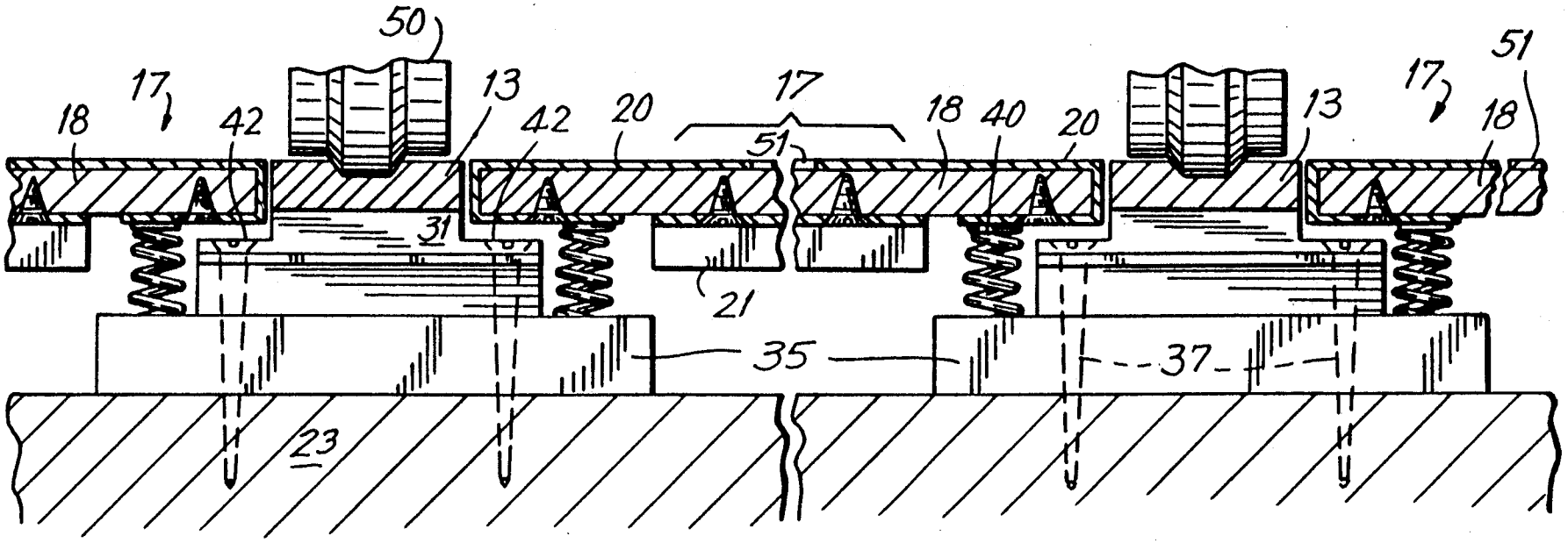

In a typical installation, with rails having a length of 2410 mm, about 11 pads would be attached to each rail. Since it is not necessary that floor spring suspensions be provided at each pad, only some of the pads 31 are mounted on blocks 35. The remaining pads would simply be provided with a block support or are shimmed up as shown at 36 in FIG. 4. The blocks 35 are typically provided at the four corners of each floor section 17, so that each floor section 17 is supported at its corners on four coil springs as illustrated in FIGS. 2 and 7B. So, for a typical panel length of 1755 mm (the vertical spacing in the FIG. 2 plane between the rails—FIG. 2 is not to scale), and a panel width of 609 mm (the horizontal dimension in FIG. 2), the typical rail accommodates four floor sections; hence, this requires, per rail, five block supports 35, which means that the remaining six pads are shimmed up 36.

Figure 8:
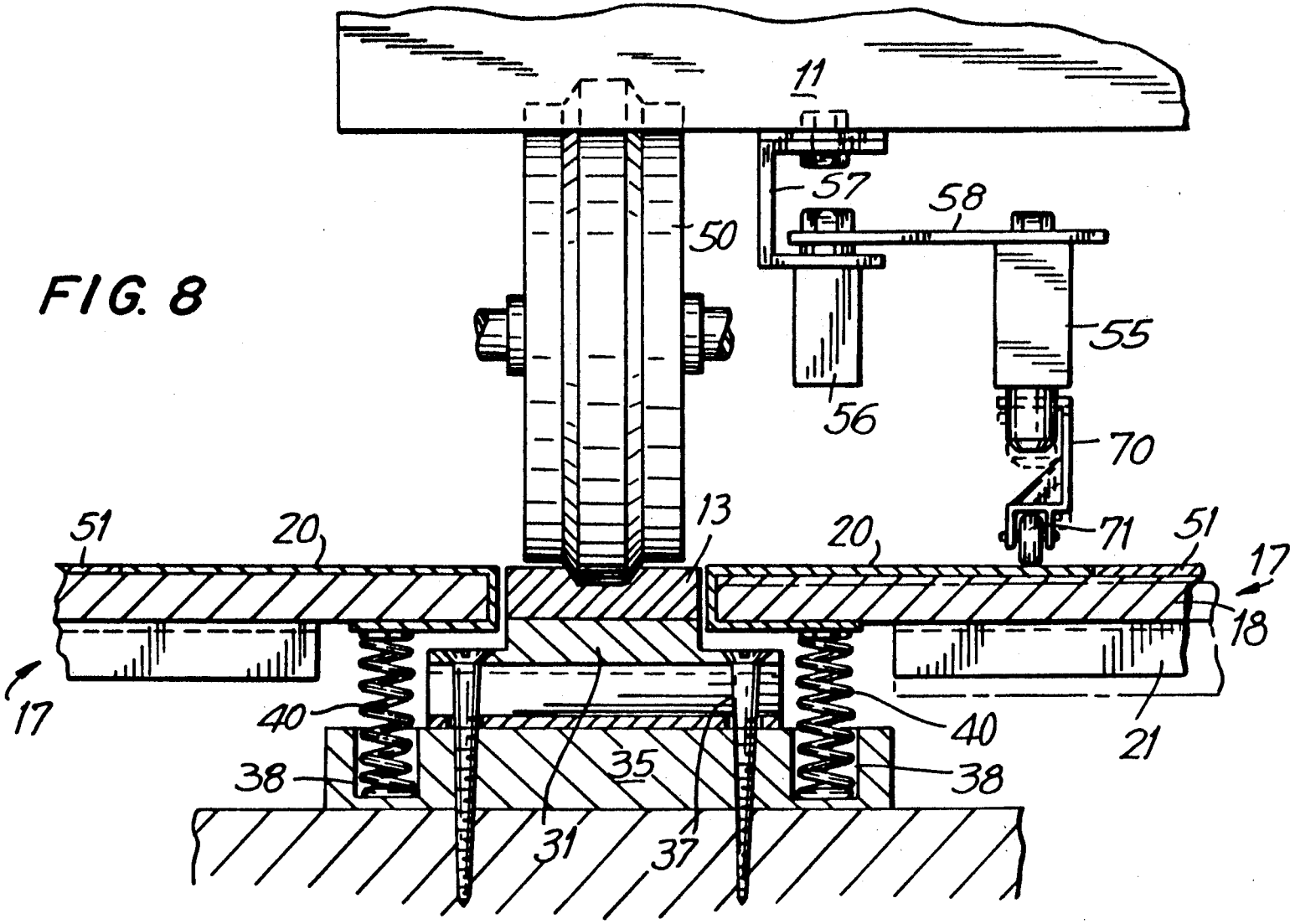

FIG. 8 is a detail view similar to FIG. 7B, but also showing the bottom of a carriage 11 on which are mounted in a conventional manner wheels 50 which can roll along the rails 13. To level up the floor section 17, a thin tile 51 is adhered to the top of the plywood 18. The tile 51 is located between the end caps 20. Mounted on the bottom at diagonally opposite positions 52 (these positions are marked as small rectangles in FIG. 2) on each carriage 11 are microswitches 55. As will be observed from FIG. 2, two microswitches are located over each floor section switches 56 at the bottom (indicated only schematically) which are used to fix the ends of the carriage movement. In other words, an actuator (not shown) is positioned on the floor at the permissible end of the carriage path. When the switch 56 is activated, then the control system for the motor drive responds by preventing further movement beyond the end stop. A bracket 57 mounts the switch 56 to the carriage bottom.

In the invention, an additional bracket 58 is attached to the first bracket 57, and the safety floor switch 55 is mounted on the additional bracket 58. The switch actuator includes an arm 70 on the bottom end of which is mounted a small wheel 71. The wheel 71 rides along the top surface of the end cap 20, and has a sufficient diameter to ride over the junction between adjacent floor sections 17. The configuration is such that the switch 55, when the floor section 17 is at rest (without a person or object on it), is in one of its two switch conditions—normally open (NO) or normally closed (NC). When a person or object is placed on a floor section 17, the latter is displaced downward. This causes the wheel 71 attached to arm 70 to drop, triggering the switch 55 to its other state or condition. Each floor section 17 is suspended by four springs 40 spaced a short distance above the top of a pad 31, so that it can move downward when a person steps on it. The top surface of the pad 31 acts as a stop to prevent the floor section 17 from moving any further. A typical downward displacement of the floor section is about 3/16–⅜ inches. Under normal conditions, with a person present on a floor section, the latter rests on the rail pads 31. When the person steps off, the floor section returns to its suspended rest position. Hence, the springs, 40 size and strength need only be sufficient to support each floor section 17 in its rest position.

Figure 9:
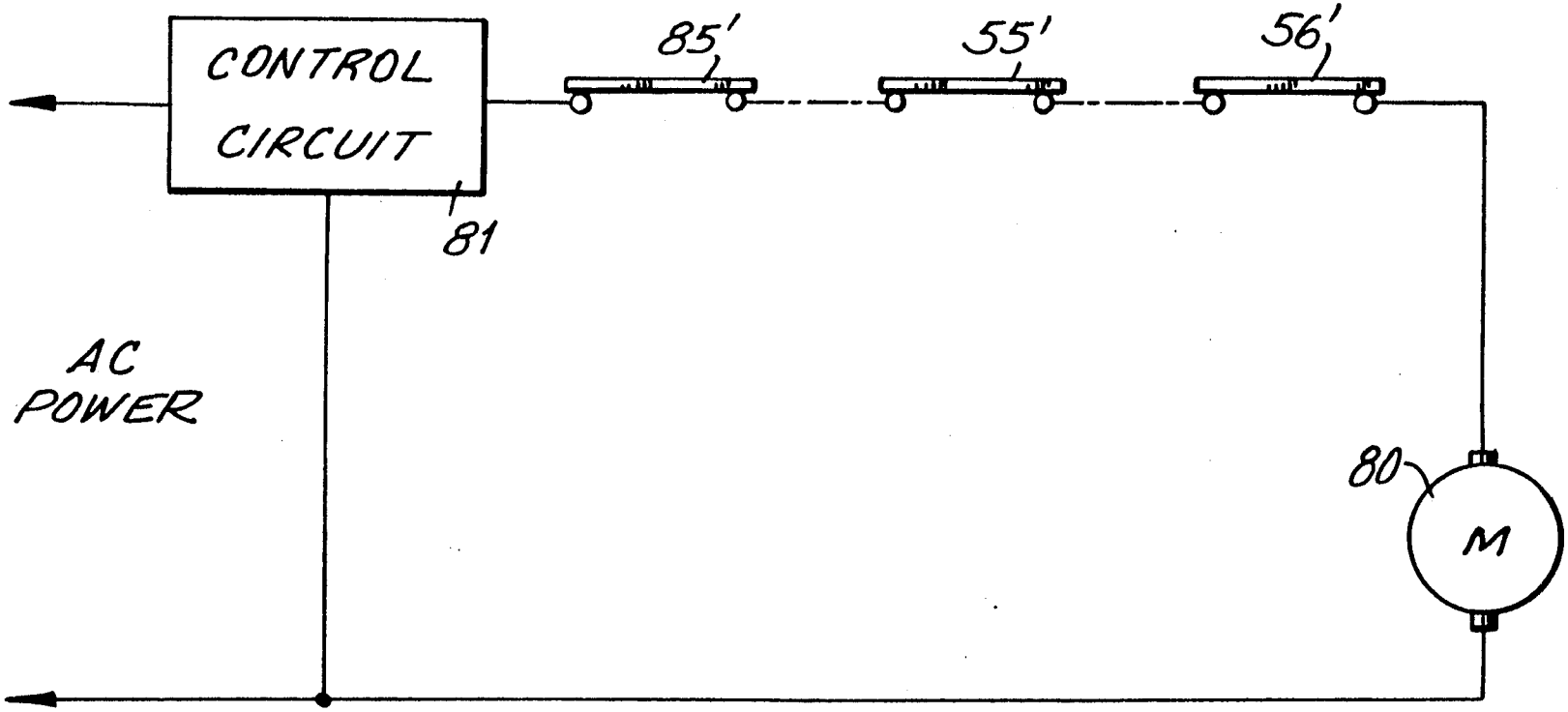
FIG. 9A is a schematic circuit diagram illustrating generally the operation of the system of FIG. 2.

FIG. 9A schematically illustrates in a simplified view numeral 80. It is supplied by AC power through a conventional control circuit 81 which determines when and in which direction a carriage motor 80 is activated when a user presses a button on a control panel 82 (FIG. 1) at the front of each carriage in order to open an aisle 14. The power to the motor passes through the NC contacts 56′ of the stop switch 56, and through the NC contacts 55′ of each of the floor safety switches 55. Only one switch 55 is shown in FIG. 9A, but it will be understood that for the 5-carriage, 3-rail illustrative system of FIG. 2, a total of 16 switches 55 will be connected in this series power path. When a floor panel is depressed and a switch 55 triggered, the NC contacts 55' open interrupting the motor 80 drive. Though not shown for simplicity, the usual safety circuit has the NC switches in series with and energizing a solenoid whose closed contacts enable the motor drive. Hence, any open switch deenergizes the solenoid which in turn disables the motor. This circuit is preferred because an inadvertent break anywhere in the circuit, due for example to a malfunction, will automatically disable the motor. It will further be understood that the invention is not limited to a series safety circuit, and other circuit configurations to accomplish the same results are deemed within the scope of our invention.

From FIG. 8, it is evident that the floor safety switches 55 are easily attached to the existing bracket support 57, and those switches readily wired in series with the existing safety bar switches 16 or stop switches 56. The addition of the safety floor will typically add no more than about 1–2 inches of height to the installation.

As will further be observed, the installation is robust. No spring or other attachments to the floor sections are needed. Each floor section floats freely suspended on the coil springs, retained in place by the rail sides and suitable end members where needed. No electrical components are mounted beneath the floor sections. Hence, inevitable collections of dirt and moisture beneath the movable floor panels cannot cause malfunctions of the electrical switches. The construction is simple, and capable of low-cost manufacture and installation. Even more important is that the installation of this improved safety system require only modest changes in the existing system components and circuitry, which further keeps the costs low.

In the usual installation, the carriages 11 are adjacent a back or rear wall. In this case, the latter can serve as the lateral constraint for any movable floor panels (not shown) located between the adjacent rail and the back wall. At the front of the carriages, it is preferred to provide a tapered ramp floor section extending from the front rail to the front edges of the carriages 11. This can be made of steel. The ramp would taper downwardly from the rail. In this case, since the front edges of the ramp rest on the existing floor, spring supports need only be provided on the block under the rail to support the deeper part of the ramp section adjacent the rail. This has been illustrated at 87 in FIG. 2.

While in the preferred embodiment electrical motors are used to move the carriages, the invention is also applicable to mechanical drive systems of the type generally disclosed in the cited related application. In the latter case, activation of the floor safety switch would be used to deenergize a solenoid preventing a brake or other kind of locking device from holding or locking the carriage axle or other element in the mechanical linkage of the carriage drive mechanism. This would prevent movement of the drive mechanism or carriage axle thereby preventing carriage movement while the floor section is depressed. When the person steps off the floor section, the safety switch is restored thereby reenergizing the solenoid to disengage the brake or lock.

Various changes in the exemplary embodiment, which is not intended to be limiting, will be evident to those skilled in art. The floor panels can be reinforced by means other than the channels 21. The rails can be mounted on to the subfloor with other pad configurations. The end caps 30 can be replaced by flat metal strips located on top of the panel for the switch followers 71 and square metal plates on the bottom of the panel at positions overlying each of the springs 40. Other circuit arrangement to accomplish the same functions will be evident to those skilled in the art.

While the invention has been described and illustrated in connection with a preferred embodiment, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. A mobile shelving system comprising:

(a) plural carriages having storage means, (b) means for selectively moving the carriages toward and away from each other to selectively form access aisles between adjacent carriages, (c) a floor beneath the plural carriages for supporting a user when accessing the storage means on a carriage adjacent an open aisle, (d) means for supporting said floor so as to be movable when a user steps on the floor when entering an open aisle, (e) drive means connected to the carriage moving means for operating the moving means when activated, (f) switch means connected to the drive means for disabling the drive means when any of the switch means is triggered, each of said switch means being mounted on a carriage and being activated in response to movement of said floor when a user steps on the floor to trigger the switch means and thereby disable the moving means to prevent inadvertent closing of the aisle while a user is present in the aisle.

2. The mobile shelving system of claim 1, wherein the drive means comprises an electrical circuit, and the switch means comprises plural switches.

3. The mobile shelving system of claim 2, wherein the floor moves vertically and the switch means comprises a microswitch with an actuating arm that rides along the surface of the floor.

4. The mobile shelving system of claim 1, wherein the supporting means for said floor comprises means supporting a plurality of springs supported in engagement with and suspending the floor.

5. The mobile shelving system of claim 4, wherein the springs are compression springs.

6. The mobile shelving system of claim 4, wherein the supporting means for said floor comprises a plurality of blocks each supporting a said spring in engagement with the floor and suspending the floor spaced above the blocks.

7. The mobile shelving system of claim 6, further comprising plural spaced rails, said carriages having wheels engaging the rails for enabling movement of the carriages along the rails, said rails being mounted over said blocks.

8. The mobile shelving system of claim 7, further comprising plural spaced pads mounted to each rail, said blocks being mounted under only some of the pads, shim means located beneath those pads free of the blocks and assisting in supporting the rails.

9. The mobile shelving system of claim 8, wherein said floor comprises plural sections of a relatively soft material each having end members of a relatively hard material and lying over the pad edges.

10. The mobile shelving system of claim 9, wherein said switch means comprises rollers engaging and riding along the end members of the floor sections.

11. The mobile shelving system of claim 10, further comprising reinforcing means attached to the bottom of each floor section.

12. The mobile shelving system of claim 9, wherein said floor comprises wood, and the end members are of steel.

13. The mobile shelving system of claim 6, wherein the springs are heavy duty coil springs.

* * * * *